US008545249B2

(12) United States Patent
Kuan

(10) Patent No.: US 8,545,249 B2
(45) Date of Patent: Oct. 1, 2013

(54) LOCKING ASSEMBLY AND COMMUNICATION APPARATUS USING SAME

(75) Inventor: Chang-Ming Kuan, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 59 days.

(21) Appl. No.: 13/415,848

(22) Filed: Mar. 9, 2012

(65) Prior Publication Data

US 2013/0102179 A1 Apr. 25, 2013

(30) Foreign Application Priority Data

Oct. 19, 2011 (TW) ..... 100219522

(51) Int. Cl.
*H01R 13/62* (2006.01)

(52) U.S. Cl.
USPC ..... 439/327; 361/679.33

(58) Field of Classification Search
USPC ..... 439/152–160, 327, 328, 372, 377; 361/679.31–679.33, 737, 801, 802, 807, 361/810
See application file for complete search history.

(56) References Cited

U.S. PATENT DOCUMENTS

| | | | | |
|---|---|---|---|---|
| 6,646,871 | B1 * | 11/2003 | Liao et al. | 361/679.36 |
| 7,335,045 | B1 * | 2/2008 | Liang | 439/327 |
| 7,630,212 | B2 * | 12/2009 | Fan et al. | 361/798 |
| 7,835,148 | B2 * | 11/2010 | Tu | 361/679.39 |
| 7,848,099 | B1 * | 12/2010 | Zhang et al. | 361/679.38 |
| 7,864,522 | B1 * | 1/2011 | Peng et al. | 361/679.33 |
| 8,031,465 | B2 * | 10/2011 | Chen et al. | 361/679.54 |
| 8,243,435 | B2 * | 8/2012 | Li | 361/679.37 |
| 8,373,981 | B2 * | 2/2013 | Zhang et al. | 361/679.32 |
| 8,411,429 | B2 * | 4/2013 | Li | 361/679.33 |

* cited by examiner

*Primary Examiner* — Thanh Tam Le
(74) *Attorney, Agent, or Firm* — Altis & Wispro Law Group, Inc.

(57) ABSTRACT

A locking assembly used to lock an electronic device defining at least one latching hole in a communication apparatus includes a housing including a mounting board and a front board, a latching member fixed to the mounting board, a button member mounted between the front board and the latching member, an urging member pivotably connected to the housing and an elastic member elastically connected between the housing and the urging member. The latching member includes at least one latching portion to engage with the at least one latching hole. When the button member moves relative to the housing and compels the at least one latching portion to disengage with the at least one latching hole, the urging member is enabled to push the electronic device to move out from the communication apparatus via elastic deformation energy of the elastic member.

20 Claims, 9 Drawing Sheets

LOCKING ASSEMBLY AND COMMUNICATION APPARATUS USING SAME

BACKGROUND

1. Technical Field

The present disclosure relates to communication apparatuses, and more particularly to a locking assembly to lock an electronic device in a communication apparatus.

2. Description of Related Art

Generally, many electronic devices incorporate modular components such as removable power supplies, removable hard disks, and removable fans. Such components have been widely used in computers, servers, redundant arrays of independent disks (RAIDs), and other communication apparatuses. These electronic devices can, for example, supply continuous electric power or data storage space. In addition, these electronic devices provide users the convenience of easily taking out or exchanging a power supply, a hard disk or a fan, for example.

A common kind of electronic device, such as a removable hard disk, is mounted in a housing structure by bolts or screws. When the electronic device needs to be taken out from the housing structure, the bolts or screws must firstly be removed. Therefore, it is inconvenient to install or remove the electronic device into or from the housing structure.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings. It should be noted that references to "an" or "one" embodiment in this disclosure are not necessarily to the same embodiment, and such references can mean "at least one."

Figure 1:
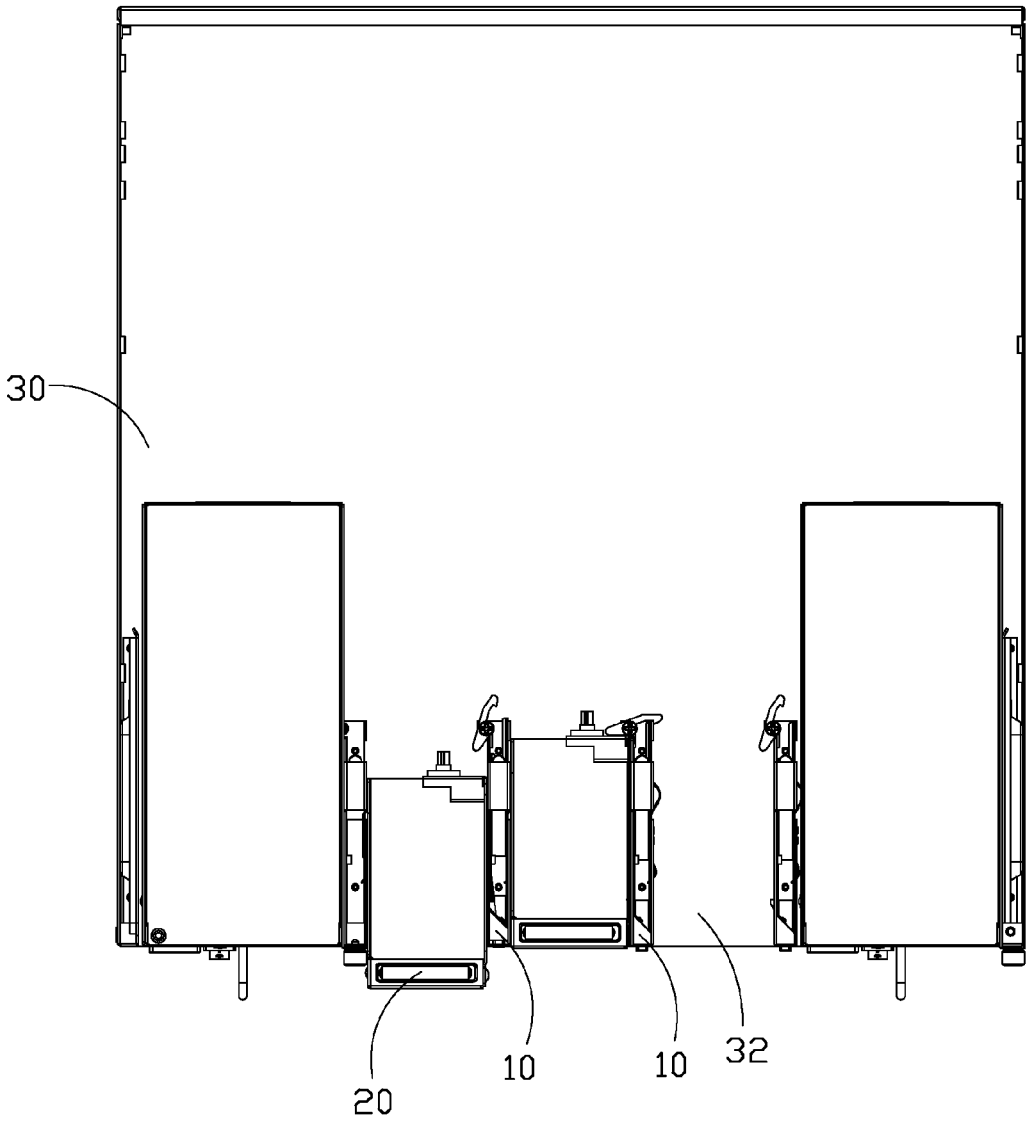
FIG. 1 is a schematic view of an exemplary embodiment of a locking assembly in accordance with the present disclosure, showing three locking assemblies fixed in a communication apparatus, and two electronic devices secured in the communication apparatus.

Referring to FIG. 1, at least two locking assembly 10 are used to lock at least one electronic device 20 in a communication apparatus 30, or remove the at least one electronic device 20 from the communication apparatus 30. In the illustrated embodiment, the at least one electronic device 20 may be a removable power supply, a removable hard disk or a removable fan, and accordingly the communication apparatus 30 may be a computer, a server, a redundant array of an independent disks (RAID), for example. The at least two locking assemblies 10 are fixed in the communication apparatus 30 and parallel with each other to collectively form an accommodate space 32, and the at least one electronic device 20 is secured in the accommodate space 32 between two adjacent locking assemblies 10.

Figure 2:
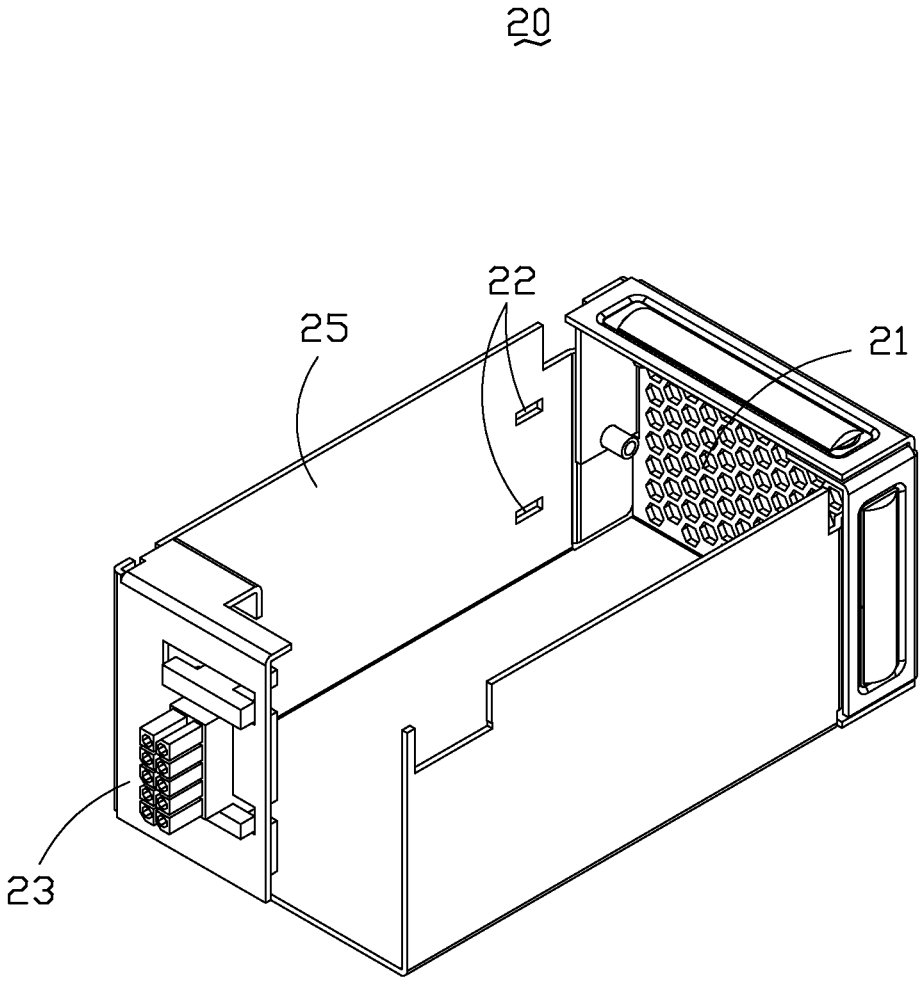
FIG. 2 is a schematic view of the electronic device of FIG. 1.
Figure 3:
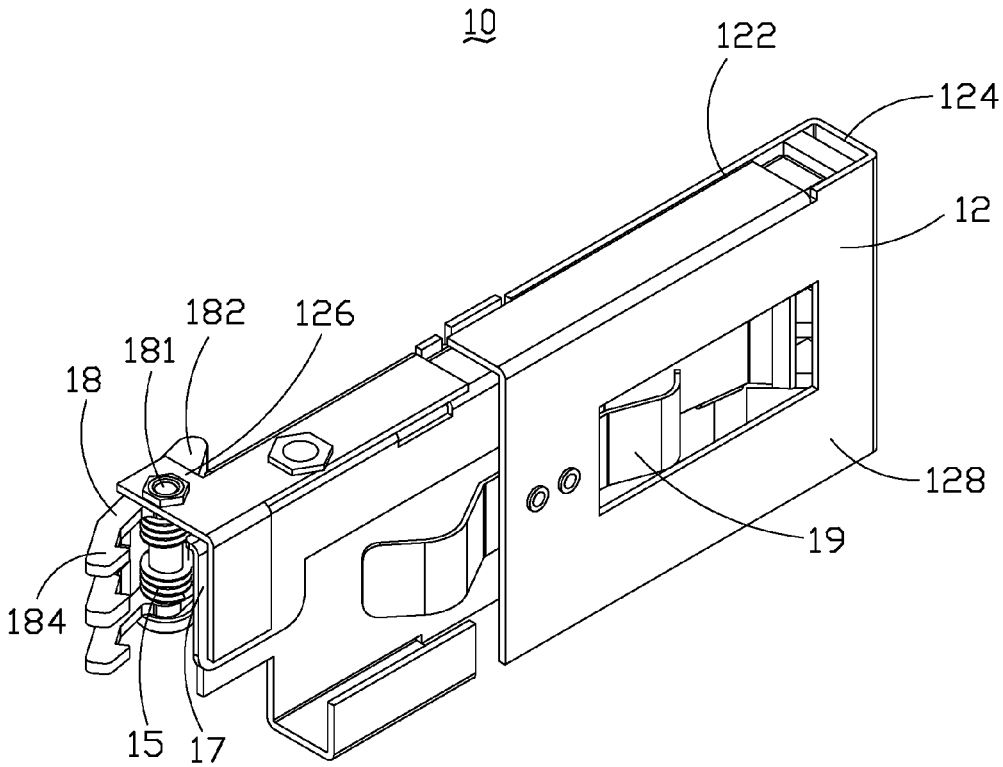
FIG. 3 is a perspective view of the locking assembly of FIG. 1.
Figure 4:
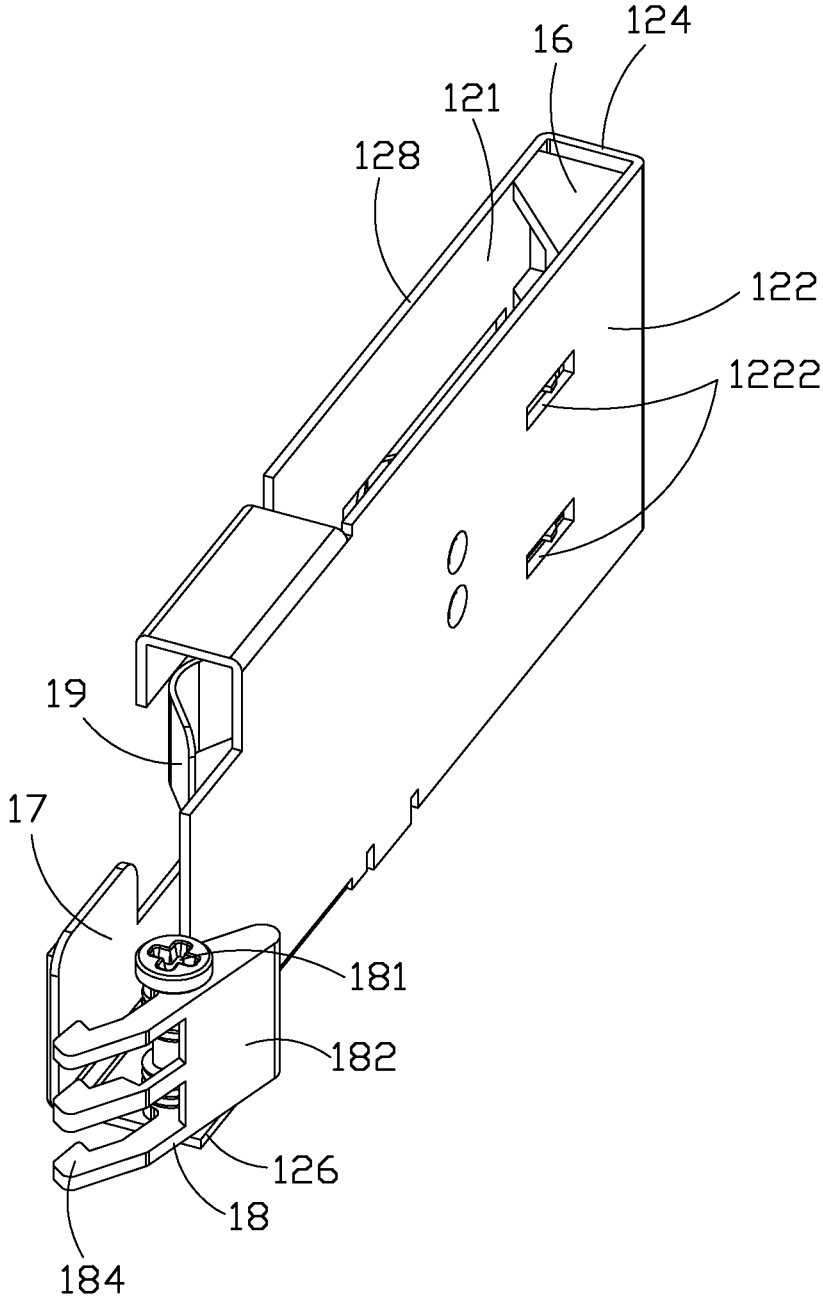
FIG. 4 is similar to FIG. 3, but showing from another aspect.
Figure 5:
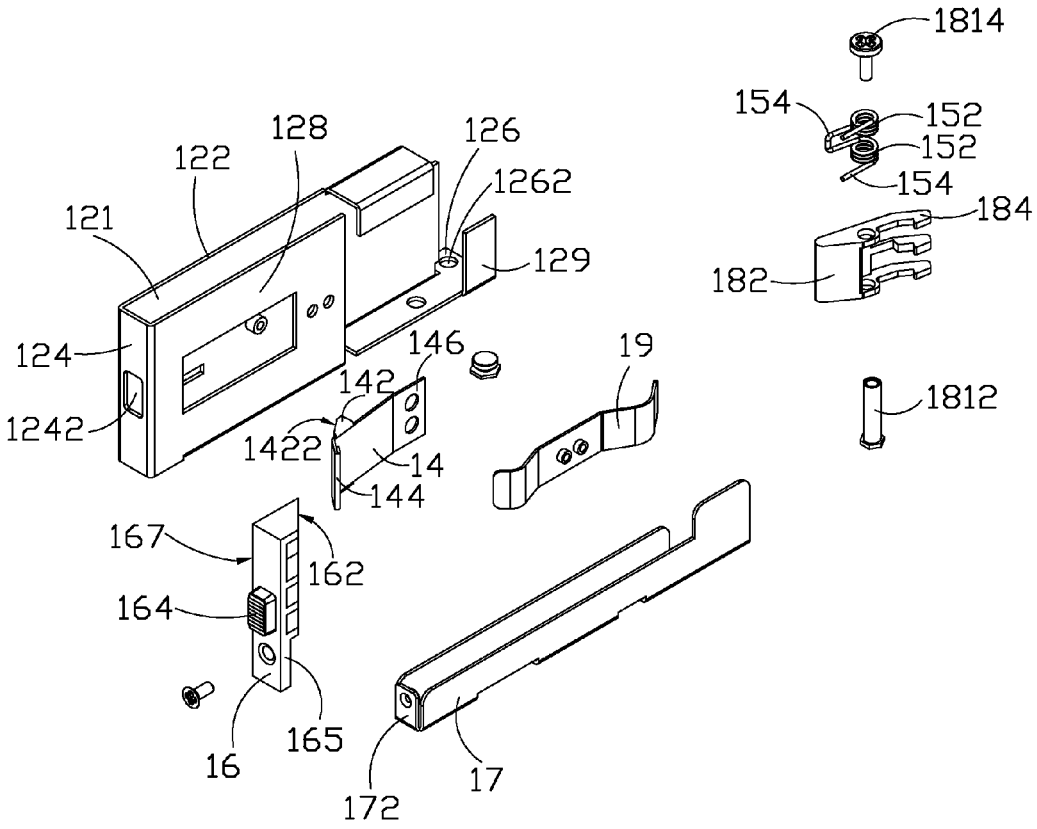
FIG. 5 is a disassembled perspective view of the locking assembly.
Figure 6:
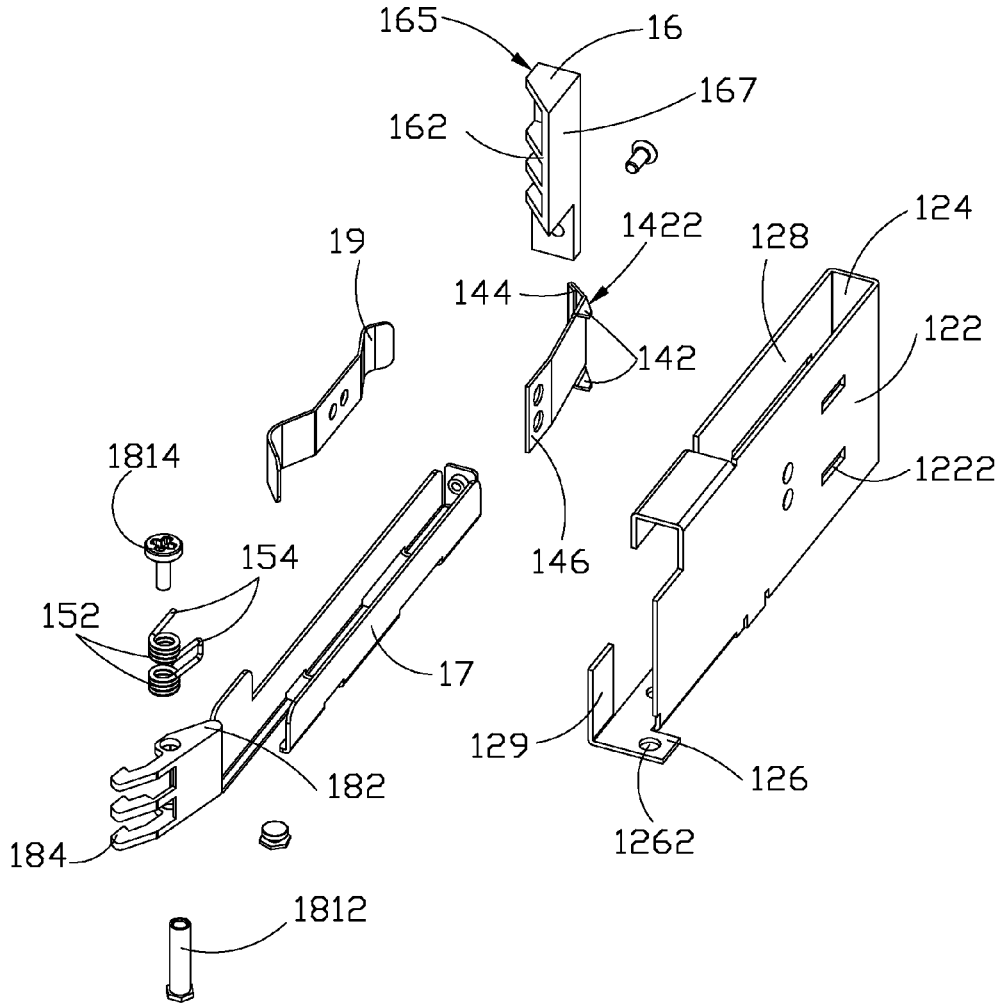
FIG. 6 is similar to FIG. 5, but showing from another aspect.

Referring to FIG. 2, each of the at least one electronic device 20 includes a front panel 21, a back wall 23 opposite to the front panel 21, and a pair of sidewalls 25 opposite with each other and connected between the front panel 21 and the back wall 23. The electronic device 20 defines at least one latching hole 22 configured on one of the pair of sidewalls 25 and adjacent to the front panel 21. In this embodiment, a number of the latching holes 22 may be two.

Referring to FIGS. 3-6, each of the at least two locking assembly 10 comprises a housing 12, a latching member 14, a button member 16, an urging member 18, and an elastic member 15. The housing 12 comprises a mounting board 122, a front board 124 perpendicularly extending from one end of the mounting board 122 and a pivoting portion 126 configured on the other end of the mounting board 122. The mounting board 122 defines at least one through hole 1222, which is opposite to the at least one latching hole 22 of the electronic device 20 when the electronic device 20 is locked in the communication device 30. In this embodiment, the mounting board 122 defines two through holes 1222. The housing 12 further comprises a limiting board 128 perpendicularly extending from the front board 124 and parallel with the mounting board 122, and a securing board 129 opposite to the pivoting portion 126 and coplanar with the limiting board 128. The mounting board 122, the front board 124 and the limiting board 128 cooperatively define a receiving room 121.

The latching member 14 is fixed to the mounting board 122 and comprises at least one latching portion 142 and a guiding portion 144. The latching portion 142 passes through the through hole 1222 of the mounting board 122 to engage with the latching hole 22, to lock the electronic device 20 in the communication device 30. The latching portion 142 comprises a first inclined plane 1422 ramped relative to the mounting board 122 and facing to the front board 124. The guiding portion 144 extends from the latching portion 142 toward the front board 124, and a wedged room is formed between the guiding portion 144 and the mounting board 122. In this embodiment, the latching member 14 can be integrally fabricated from a metal sheet and comprises two latching portions 142 respectively corresponding to the through holes 1222 of the housing 12. The latching member 14 further comprises a fixing portion 146 located at one side of the latching portion 142 away from the guiding portion 144 and fixed to the mounting board 122 via screws.

Figure 7:
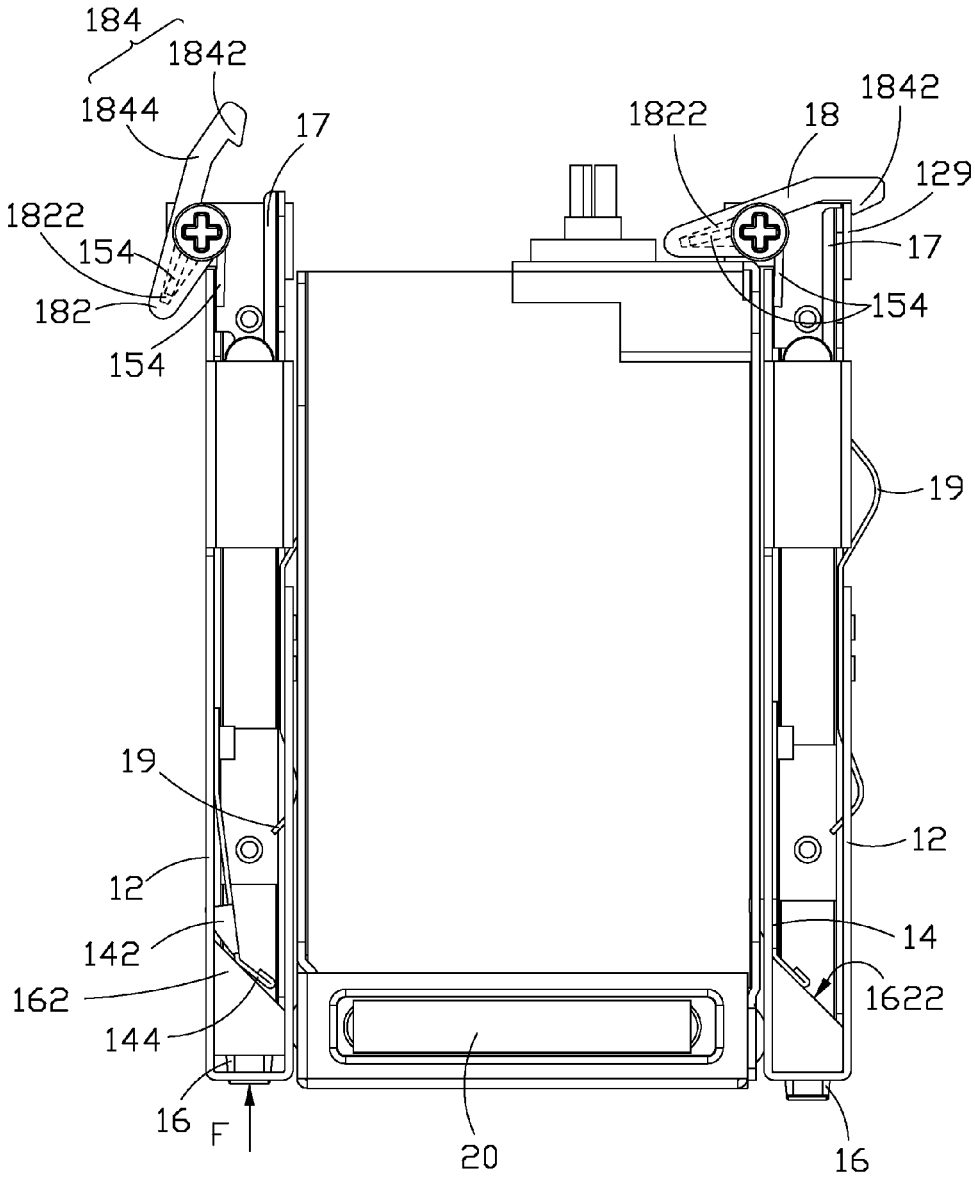
FIG. 7 is a partially enlarged view of FIG. 1, showing engagement between the locking assembly and the electronic device.
Figure 8:
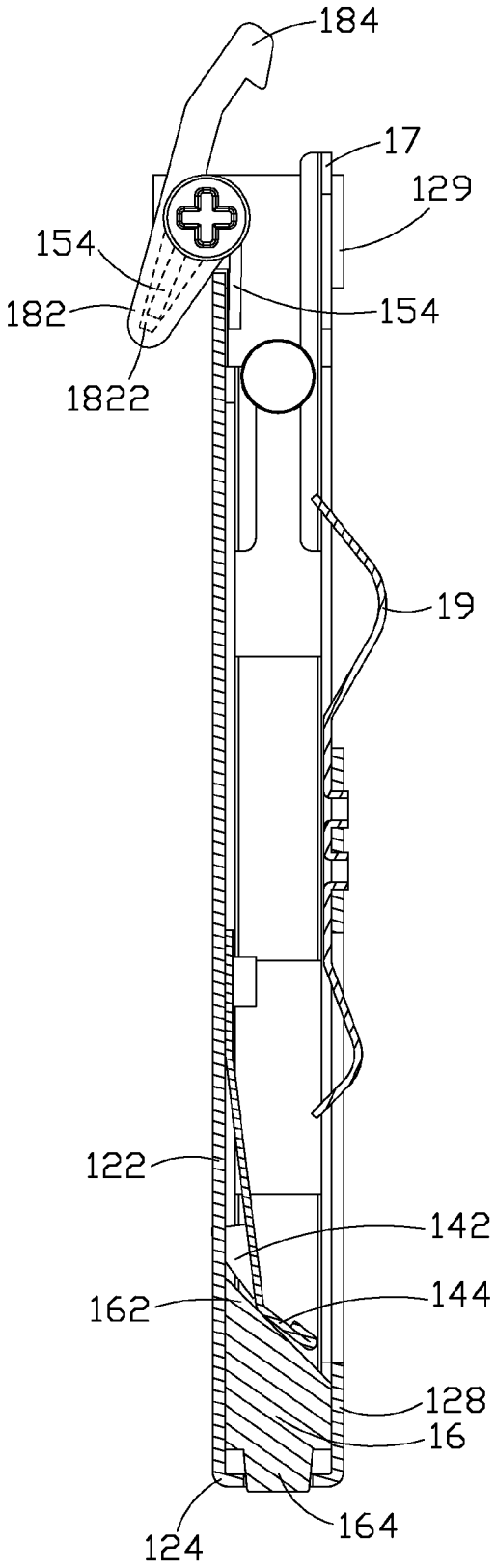
FIG. 8 is a cross-sectional view of the locking assembly, showing engagement between a button member and a latching member.

The button member 16 is movably connected between the front board 124 and the latching member 14 and partially passes through a through hole 1242 of the front board 124. The button member 16 comprises a driving portion 162 and an operating portion 164. Referring to FIGS. 7-8, the driving portion 162 extends into the wedged room between the guiding portion 144 and the mounting board 122, and is used to push and deform the latching member 14 to release the at least one latching portion 142 from the at least one latching hole 22. That is, the driving portion 162 is configured on one end of the button member 16 and positioned between the guiding portion 144 and the mounting board 122. The driving portion 162 comprises a second inclined plane 1622 facing and contacting the guiding portion 144 of the latching member 14. The operating portion 164 is configured on another end of the driving portion 162 away from the second inclined plane 1622 and passes through the through hole 1242 of the front board 124 to be exposed outside of the housing 12 for operation. When an external force F is applied on the operating portion 164 and makes the button member 16 move relative to the housing 12, the driving portion 162 moves to the latching portion 142 of the latching member 14 and compels the latching portion 142 move to disengage with the latching hole 22 and be retracted into the receiving room 121.

In this embodiment, two opposite edges 165, 167 of the button member 16 respectively contact the mounting board 122 and the limiting board 128, to provide a stable movement of the button member 16 under the external force F.

The urging member 18 is pivotably connected to the pivoting portion 126 of the housing 12 to form a shaft 181. In this embodiment, the pivoting portion 126 defines a pivoting hole 1262, a positioning post 1812 passes through the pivoting hole 1262 and the urging member 18, and ultimately engages with a screw 1814, therefore the urging member 18 is secured to the housing 12 and enable to rotate relative to the housing 12.

The elastic member 15 is elastically connected between the housing 12 and the urging member 18. In this embodiment, the elastic member 15 is a torsion spring. The elastic member 15 comprises at least two bending portions 152 and two retaining portions 154 respectively extending from two sides of the bending portions 152. One of the two retaining portions 154 is secured to the urging member 18, and the other one of the two retaining portions 154 is secured to the mounting board 122 of the housing 12. The elastic member 15 is remained at elastic deformation state (shown in FIG. 9), when the locking assembly locks the electronic device 20 in the communication apparatus 30. When the button member 16 is pushed into the housing 12 to drive the latching member 14 to be released from the electronic device 20, shown in FIG. 8, the urging member 18 is enabled to push the electronic device 20 to move out from the communication apparatus 30 via elastic deformation energy of the elastic member 15.

Figure 9:
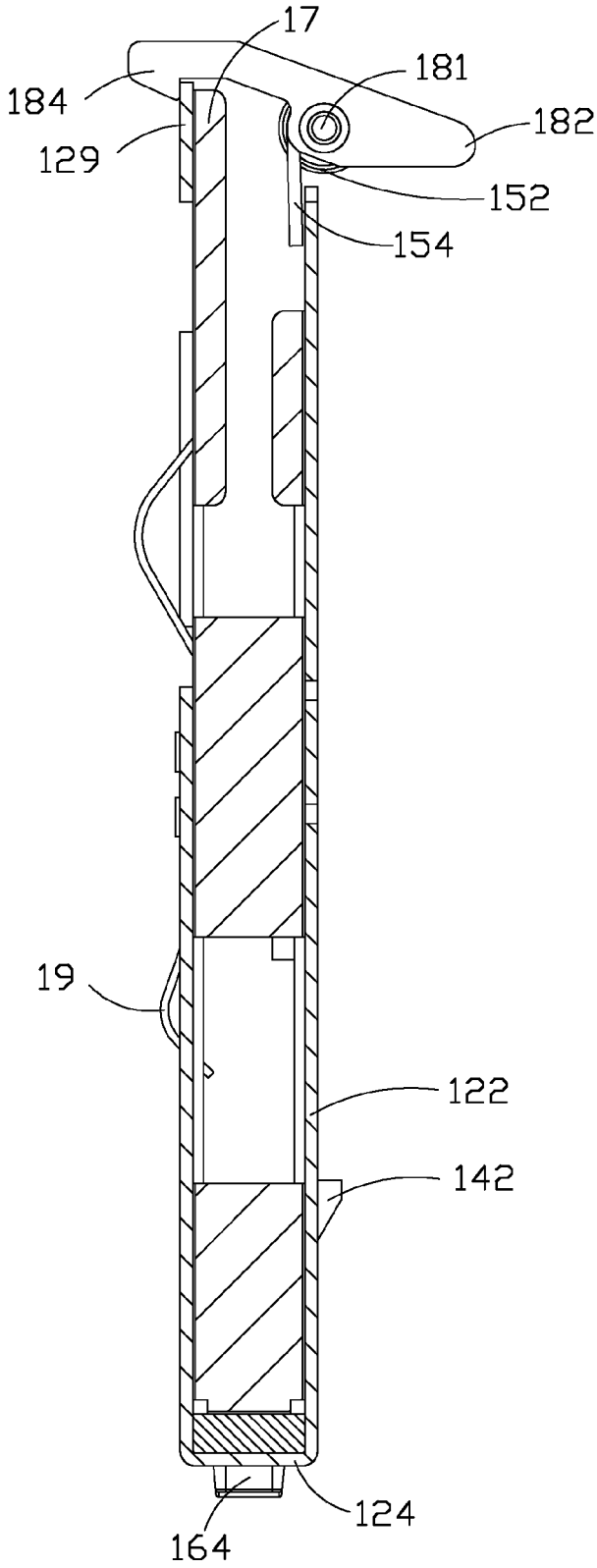
FIG. 9 is similar to FIG. 8, but showing engagement between an urging member and a pushing member.

Referring to FIGS. 7-9, the urging member 18 comprises an urging portion 182 and a securing portion 184 respectively located on two sides of the shaft 181. The urging portion 182 extends to the accommodate space 32 to meet the electronic device 20, and the securing portion 184 extends to the securing board 129 of the housing 12. That is, the urging portion 182 and the securing portion 184 are respectively locates two sides of the mounting board 122. The urging portion 182 defines a receiving slot 1822. In assembly, the bending portions 152 of the elastic member 15 coil around the shaft 181, one of the two retaining portions 154 is received in the receiving slot 1822, and the other retaining portion 154 resists against the mounting board 122. The securing portion 184 comprises a hook portion 1842 and a connecting portion 1844 connected between the hook portion 1842 and the urging portion 182. When the electronic device 20 is locked in the communication apparatus 30, the hook portion 1842 clasps the securing board 129 of the housing 12 to secure the urging member 18 to the housing 12 and counteract the elastic deformation energy of the elastic member 15.

The locking assembly 10 further comprises a pushing member 17 slidably connected to the housing 12. The pushing member 17 is connected to the button member 16 and extends to the urging member 18. The button member 16 is pushed to drive the pushing member 17 to slide in the housing 12 and move the connecting portion 1844 of the urging member 18, to make the hook portion 1842 disengages with the securing board 129. That is, the pushing member 17 and the elastic member 15 cooperatively drive the electronic device 20 move out from the communication apparatus 30.

In this embodiment, the locking assembly 10 further comprises a spring sheet 19 fixed to the limiting board 128 of the housing 12 and extending away from the mounting board 122. When the electronic device 20 is installed into the communication apparatus 30 and locked between two adjacent locking assemblies 10, the latching member 14 of one of the two adjacent locking assemblies 10 engages with the latching hole 22 of the electronic device 20, and the spring sheet 19 of the other locking assembly 10 resists the electronic device 20 to provide a secure fixation between the electronic device 20 and the latching member 14.

The latching portion 142 of the latching member 14 passes through the through hole 1222 and extends to outside of the housing 12, when no external force is applied on the button member 16. That is, the latching portion 142 extends into the accommodate space 32 between two adjacent locking assemblies 10 when no electronic device 22 is installed into the accommodate space 32. When the electronic device 20 moves into the accommodate space 32, the electronic device 20 pushes and deforms the latching portion 142 and make the latching portion 142 move into the housing 12 via the electronic device 20 urging the first inclined plane 1422. The latching portion 142 meets and engages with the latching hole 22 with continuous movement of the electronic device 20, thereby the electronic device 20 being locked in the communication apparatus 30. Simultaneously, the back wall 23 of the electronic device 20 urges on the urging portion 182 of the urging member 18 and make the urging member 18 rotate about the shaft 181, ultimately, the hook portion 1842 of the securing portion 184 clasps the securing board 129 of the housing 12 to fix the urging member 18 to the housing 12 and counteract the elastic deformation energy of the elastic member 15.

When the electronic device 20 is required to be released from the communication apparatus 30, the external force F is applied on the button member 16 to make the button member 16 move in the housing 12 to push and deform the latching member 14, thus, the latching portion 142 is retreated from the latching hole 22. Simultaneously, the button member 16 drives the pushing member 17 to slide in the housing 12 and push the connecting portion 1844 of the urging member 18, to make the hook portion 1842 disengages with the securing board 129. In this condition, the elastic member 15 drives the urging member 18 rotate about the shaft 181, and make the urging portion 182 of the urging member 18 urge the electronic device 20, to make the electronic device 20 move out from the communication apparatus 30.

In another embodiment, the locking assembly 10 comprises the housing 12, the latching member 14, the button member 16, the urging member 18 and the pushing member 17. When the button member 16 moves relative to the housing 12 and compel the at least one latching portion 142 of the latching member 14 to disengage with the at least one latching hole 22 of the electronic device 20, simultaneously, the button member 16 drives the pushing member 17 to slide in the housing 12 and push the urging member 18 to make the urging member 18 urge and push the electronic device 20 to move out from the communication apparatus 30.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A locking assembly, used to lock an electronic device defining at least one latching hole in a communication apparatus, the locking assembly comprising:

a housing, comprising a mounting board, a front board extending from one end of the mounting board and a pivoting portion configured on another end of the mounting board opposite to the front board;

a latching member, fixed to the mounting board and comprising at least one latching portion passing through the mounting board to engage with the at least one latching hole to lock the electronic device in the communication device;

a button member, movably connected between the front board and the latching member and partially passing through the front board;

an urging member, pivotably connected to the pivoting portion of the housing; and an elastic member, elastically connected between the housing and the urging member;

wherein when the button member moves relative to the housing and compels the at least one latching portion to disengage with the at least one latching hole, the urging member is enabled to push the electronic device to move out from the communication apparatus via elastic deformation energy of the elastic member.

2. The locking assembly of claim 1, wherein the latching member comprises a guiding portion extending from the latching portion toward the front board, and the button member comprises a driving portion positioned between the guiding portion and the mounting board.

3. The locking assembly of claim 2, wherein the latching portion comprises a first inclined plane ramped relative to the mounting board and facing to the front board, and the driving portion comprises a second inclined plane facing and contacting the guiding portion of the latching member.

4. The locking assembly of claim 1, further comprising a pushing member slidably connected to the button member and extending to the urging member, wherein the urging member comprises an urging portion configured to urge and move the electronic device out from the communication apparatus and a securing portion enabled to clasp the housing, the urging portion and the securing portion are respectively located on two sides of the mounting board, and the pushing member is enabled to be driven by the button member to make the securing portion disengage with the housing.

5. The locking assembly of claim 4, wherein the housing further comprises a securing board opposite to the pivoting portion, the securing portion comprises a hook portion and a connecting portion connected between the hook portion and the urging portion, the hook portion is used to clasp the securing board to secure the urging member to the housing, and the hook portion disengages with the securing board via the pushing member pushing the connecting portion.

6. The locking assembly of claim 4, wherein the elastic member is a torsion spring.

7. The locking assembly of claim 6, wherein the elastic member comprises at least two bending portions coiling around a shaft pivotably connected between the urging member and the pivoting portion, and two retaining portions respectively extending from two sides of the at least two bending portions, one of the two retaining portions is secured in a receiving slot defined in the urging member, and the other one of the two retaining portions is secured to the mounting board.

8. The locking assembly of claim 1, wherein the housing further comprises a limiting board extending from the front board and parallel with the mounting board, the mounting board, the front board and the limiting board cooperatively define a receiving room to receive the latching member and the button member, and two opposite edges of the button member respectively contact the mounting board and the limiting board.

9. The locking assembly of claim 8, further comprising a spring sheet fixed to the limiting board and extending away from the mounting board.

10. A communication apparatus, defining an accommodate space used to receive an electronic device defining at least one latching hole, and comprising a locking assembly fixed on one side of the accommodate space, the locking assembly comprising:

a housing, comprising a mounting board, a front board extending from one end of the mounting board and a pivoting portion configured on another end of the mounting board opposite to the front board;

a latching member, fixed to the mounting board and comprising at least one latching portion passing through the mounting board to engage with the at least one latching hole to lock the electronic device in the communication device;

a button member, movably connected between the front board and the latching member and partially passing through the front board;

an urging member, pivotably connected to the pivoting portion of the housing; and an elastic member, elastically connected between the housing and the urging member;

wherein when the button member moves relative to the housing and compels the at least one latching portion to disengage with the at least one latching hole, the urging member is enabled to push the electronic device to move out from the communication apparatus via elastic deformation energy of the elastic member.

11. The communication apparatus of claim 10, wherein the latching member comprises a guiding portion extending from the latching portion toward the front board, and the button member comprises a driving portion positioned between the guiding portion and the mounting board.

12. The communication apparatus of claim 11, wherein the latching portion comprises a first inclined plane ramped relative to the mounting board and facing to the front board, and the driving portion comprises a second inclined plane facing and contacting the guiding portion of the latching member.

13. The communication apparatus of claim 10, wherein the locking assembly further comprises a pushing member slidably connected to the button member and extending to the urging member, the urging member comprises an urging portion configured to urge and move the electronic device out from the communication apparatus and a securing portion enabled to clasp the housing respectively located on two sides of the mounting board, the pushing member is enabled to be driven by the button member to make the securing portion disengage with the housing.

14. The communication apparatus of claim 13, wherein the housing further comprises a securing board opposite to the pivoting portion, the securing portion comprises a hook portion and a connecting portion connected between the hook portion and the urging portion, the hook portion is used to clasp the securing board to secure the urging member to the housing, and the hook portion disengages with the securing board via the pushing member pushing the connecting portion.

15. The communication apparatus of claim 13, wherein the elastic member is a torsion spring.

16. The communication apparatus of claim 15, wherein the elastic member comprises at least two bending portions coiling around a shaft pivotably connected between the urging member and the pivoting portion, and two retaining portions respectively extending from two sides of the at least two bending portions, one of the two retaining portions is secured in a receiving slot defined in the urging member, and the other one of the two retaining portions is secured to the mounting board.

17. The communication apparatus of claim 10, wherein the housing further comprises a limiting board extending from the front board and parallel with the mounting board, the mounting board, the front board and the limiting board cooperatively define a receiving room to receive the latching member and the button member, and two opposite edges of the button member respectively contact the mounting board and the limiting board.

18. The communication apparatus of claim 17, wherein the locking assembly further comprises a spring sheet fixed to the limiting board and extending away from the mounting board.

19. A locking assembly, used to lock an electronic device defining at least one latching hole in a communication apparatus, the locking assembly comprising:

a housing, comprising a mounting board, a front board extending from one end of the mounting board and a pivoting portion configured on another end of the mounting board opposite to the front board;

a latching member, fixed to the mounting board and comprising at least one latching portion passing through the mounting board to engage with the at least one latching hole to lock the electronic device in the communication device;

a button member, movably connected between the front board and the latching member and partially passing through the front board;

an urging member, pivotably connected to the pivoting portion of the housing; and a pushing member, slidably connected to the button member and extending to the urging member;

wherein when the button member moves relative to the housing and compels the at least one latching portion to disengage with the at least one latching hole, simultaneously, the button member drives the pushing member to slide in the housing and pushes the urging member to make the urging member push the electronic device to move out from the communication apparatus.

20. The locking assembly of claim 19, further comprising an elastic member elastically connected between the housing and the urging member, wherein the pushing member and the elastic member cooperatively drive the electronic device move out from the communication apparatus.

* * * * *